US010107521B2

(12) United States Patent
Sato et al.

(10) Patent No.: US 10,107,521 B2
(45) Date of Patent: Oct. 23, 2018

(54) CONNECTED HOT-WATER SUPPLY SYSTEM

(71) Applicant: RINNAI CORPORATION, Nagoya-shi, Aichi (JP)

(72) Inventors: Eri Sato, Aichi (JP); Hideki Kitagawa, Aichi (JP)

(73) Assignee: RINNAI CORPORATION, Nagoya-Shi (JP)

( * ) Notice: Subject to any disclaimer, the term of this patent is extended or adjusted under 35 U.S.C. 154(b) by 325 days.

(21) Appl. No.: 14/966,188

(22) Filed: Dec. 11, 2015

(65) Prior Publication Data

US 2016/0187029 A1 Jun. 30, 2016

(30) Foreign Application Priority Data

Dec. 25, 2014 (JP) ..... 2014-262428

(51) Int. Cl.

| | |
|---|---|
| ***F24H 9/20*** | (2006.01) |
| ***F24H 1/20*** | (2006.01) |
| ***F24H 9/12*** | (2006.01) |
| ***F23N 3/08*** | (2006.01) |

(52) U.S. Cl.

CPC ..... *F24H 9/2085* (2013.01); *F23N 3/082* (2013.01); *F24H 1/20* (2013.01); *F24H 9/124* (2013.01); *F23N 2041/04* (2013.01)

(58) Field of Classification Search

USPC ..... 122/14.1; 700/300

See application file for complete search history.

(56) References Cited

U.S. PATENT DOCUMENTS

| | | | | |
|---|---|---|---|---|
| 4,819,587 | A * | 4/1989 | Tsutsui | F23N 1/082 122/14.2 |
| 8,251,297 | B2 * | 8/2012 | Pouchak | F23N 5/00 122/448.1 |
| 8,371,252 | B1 * | 2/2013 | Paine | F24H 9/2035 122/448.3 |
| 2012/0046801 | A1 * | 2/2012 | Mori | F24H 1/145 700/300 |
| 2012/0191256 | A1 * | 7/2012 | Deivasigamani | F24D 17/0026 700/276 |
| 2015/0114313 | A1 * | 4/2015 | Huang | F24H 1/145 122/14.1 |

FOREIGN PATENT DOCUMENTS

| | | |
|---|---|---|
| JP | 2003-130344 | 5/2003 |
| JP | 2011-158138 | 8/2011 |

OTHER PUBLICATIONS

Japanese Office Action with English Machine Translation dated Jul. 12, 2016, 7 pages.

* cited by examiner

*Primary Examiner* — Steven B McAllister
*Assistant Examiner* — John Bargero
(74) *Attorney, Agent, or Firm* — Rankin, Hill & Clark LLP

(57) ABSTRACT

To provide a connected hot-water supply system capable of preventing combustion failure of the burner of each hot-water supplier during hot-water supply operation to achieve stable hot-water supply operation. When dispersion in the rotation speed of a fan 15 among respective hot-water suppliers 1 is detected, a connection control unit 2 regulates the combustion amount of each of the hot-water suppliers 1 so as to reduce a difference in the rotation speed of the fan 15 among the respective hot-water suppliers 1.

4 Claims, 4 Drawing Sheets

CONNECTED HOT-WATER SUPPLY SYSTEM

BACKGROUND OF THE INVENTION

Field of the Invention

The present invention relates to a connected hot-water supply system including a connection control unit connected to a plurality of hot-water suppliers to control operation of the respective hot-water suppliers.

Description of the Related Art

Connected hot-water supply systems that use a plurality of hot-water suppliers in accordance with required hot-water supply capacity have conventionally been known (see, for example, Japanese Laid-open Patent Publication No. 2011-158138). The connected hot-water supply systems of this type, unlike large-size hot-water suppliers that are custom-designed at high cost, can be installed by connecting a plurality of general-purpose low-cost hot-water suppliers in accordance with required hot-water supply capacity. Therefore, the connected hot-water supply systems can reduce the cost of hot-water supply equipment.

When the hot-water suppliers which constitute a connected hot-water supply system are gas combustion-based suppliers including a burner, what is called a common vent system is adopted in which exhaust ducts (exhaust passages) of the respective hot-water suppliers are connected to a common exhaust duct (common exhaust passage) to collectively discharge combustion exhaust from the plurality of exhaust ducts through the single common exhaust duct. By adopting the common vent system, not only the cost of the exhaust ducts can be reduced, but also the installing space of the exhaust ducts can be reduced.

However, since a plurality of exhaust ducts of the respective hot-water suppliers are connected to a single common exhaust duct in the common vent system, a difference in pressure of the combustion exhaust among the respective exhaust ducts, if generated, may exert an adverse influence on the combustion of the respective hot-water suppliers.

More specifically, each of the hot-water suppliers that constitute the connected hot-water supply system controls the rotation speed of the fan that feeds combustion air in accordance with a combustion amount of the burner (quantity of heat in combustion of the burner, or heating capacity of the burner during combustion). Accordingly, if, for example, the combustion amount of one hot-water supplier becomes smaller than that of other hot-water suppliers while all the hot-water suppliers that constitute the connected hot-water supply system are in hot-water supply operation, the rotation speed of the fan that feeds combustion air to the burner in accordance with the combustion amount is dropped in that one hot-water supplier, which results in a drop in the pressure of combustion exhaust. In the hot-water supplier where the pressure of combustion exhaust is dropped, smooth exhausting operation is hindered due to a relatively high pressure of the combustion exhaust from other hot-water suppliers, which may increase exhalation resistance and cause combustion failure of the burner.

In view of the aforementioned point, an object of the present invention is to provide a connected hot-water supply system adopting a common vent system, which is capable of preventing combustion failure of the burner of each hot-water supplier during hot-water supply operation so as to achieve stable hot-water supply operation.

SUMMARY OF THE INVENTION

In order to accomplish the above object, the present invention is a connected hot-water supply system, comprising a plurality of hot-water suppliers connected to each other, the hot-water suppliers each comprising a water flow passage, a heat exchanger provided in the water flow passage, a burner configured to heat the heat exchanger, a fan configured to make combustion air and combustion exhaust of the burner forcibly flow, an exhaust passage configured to discharge combustion exhaust of the burner that passed the heat exchanger by airstream by the fan, and a hot-water supply controller configured to control hot-water supply operation, wherein the hot-water supply controller of each of the hot-water suppliers is connected to a connection control unit configured to control linked operation of the respective hot-water suppliers, the exhaust passage of each of the hot-water suppliers is connected to a common exhaust passage configured to collectively discharge combustion exhaust from each of the hot-water suppliers, the fan of each of the hot-water suppliers is controlled to have a rotation speed corresponding to a combustion amount of the burner by the hot-water supply controller to deliver the combustion exhaust in the exhaust passage to the common exhaust passage, the connection control unit comprises a combustion regulator configured to regulate the combustion amount in each of the hot-water suppliers through the hot-water supply controller in each of hot-water suppliers and to thereby regulate the rotation speed of the fan in each of the hot-water suppliers, and the combustion regulator acquires information about hot-water supply operation from the hot-water supply controller of each of the hot-water suppliers, and when dispersion of the rotation speed of the fan among the respective hot-water suppliers is detected, the combustion regulator regulates the combustion amount of the respective hot-water suppliers to reduce a difference in the rotation speed of the fan among the respective hot-water suppliers.

According to the present invention, the connection control unit obtains the status of each of the hot-water suppliers. When dispersion in the rotation speed of the fan among the respective hot-water suppliers is detected, the connection control unit operates the hot-water supply controller of each of the hot-water suppliers to reduce the difference in the rotation speed of the fan among the respective hot-water suppliers. Specifically, when the rotation speed of the fan in one hot-water supplier is dropped for example, the combustion regulator increases the combustion amount of the hot-water supplier having the fan with a dropped speed and thereby increases the rotation speed of the fan. As a result, a difference in pressure of the combustion exhaust among the respective hot-water suppliers is reduced, which makes it possible to prevent occurrence of combustion failure and the like even when the common vent system is adopted.

In the connected hot-water supply system of the present invention, the hot-water suppliers each comprise a water amount detector configured to detect an amount of water flow in the water flow passage and a flow regulating valve configured to regulate the amount of water flow in the water flow passage, the hot-water supply controller of each of the hot-water suppliers regulates the combustion amount of the burner in accordance with the water amount detected by the water amount detector, and the combustion regulator of the connection control unit acquires the water amount detected by the water amount detector, as information about the hot-water supply operation, from the hot-water supply controller of each of the hot-water suppliers, and when dispersion in the detected water amount among the respective hot-water suppliers is detected, the combustion regulator determines that dispersion in the rotation speed of the fan among the respective hot-water suppliers occurred, and controls the flow regulating valve of each of the hot-water suppliers through the hot-water supply controller of each of the respective hot-water supplier to reduce a difference in the detected water amount among the respective hot-water suppliers.

The combustion regulator of the present invention controls the flow regulating valve of each of the hot-water suppliers through the hot-water supply controller of each of the hot-water supplier when the connection control unit detects dispersion in the detected water amount among the respective hot-water suppliers.

For example, when the detected water amount (amount of water flow in the water flow passage) in one hot-water supplier decreases, the hot-water supply controller causes a drop of the combustion amount, in order to suppress increase in the hot-water supply temperature. Although the rotation speed of the fan is also dropped in this case, the combustion regulator regulates the opening of the flow regulating valve in each of the hot-water suppliers through the hot-water supply controller of each of the hot-water suppliers to reduce a difference in the amount of water flow in the water flow passage between the hot-water supplier where the detected water amount is decreased and other hot-water suppliers. Accordingly, dispersion in the combustion amount caused by the dispersion in the amount of water flow in the water flow passage among the respective hot-water suppliers decreases, and a difference in pressure of the combustion exhaust among the respective hot-water suppliers is reduced. Therefore, it becomes possible to prevent occurrence of combustion failure and the like even when the common vent system is adopted.

In the connected hot-water supply system of the present invention, the hot-water suppliers each comprise a hot-water supply temperature detector configured to detect temperature of hot water obtained from the water flow passage, the hot-water supply controller of each of the hot-water suppliers regulates the combustion amount of the burner so that the temperature detected by the hot-water supply temperature detector reaches a target temperature, the combustion regulator of the connection control unit comprises a target temperature setting portion configured to set a target temperature for each of the hot-water supply controllers in each of the hot-water suppliers, and when the combustion regulator of the connection control unit detects dispersion in the combustion amount among the respective hot-water suppliers, the target temperature setting portion determines that dispersion in the rotation speed of the fan among the respective hot-water suppliers occurred, and sets the target temperature for each of the hot-water supply controllers of each of the hot-water suppliers so as to reduce a difference in the combustion amount among the respective hot-water suppliers.

The target temperature setting portion sets target temperatures corresponding to the dispersion in the combustion amount for the hot-water supply controllers of the respective hot-water suppliers, when the dispersion in the rotation speed of the fan occurs among the respective hot-water suppliers.

Specifically, when the detected water amount of one hot-water supplier is dropped for example, the hot-water supply controller of the one hot-water supplier causes a drop of the combustion amount in order to suppress the increase in the hot-water supply temperature. Although the rotation speed of the fan is also dropped in this case, the target temperature setting portion of the combustion regulator changes the target temperature of the hot-water supply controller of the one hot-water supplier to be higher. Consequently, the hot-water supply controller of the one hot-water supplier performs hot-water supply operation at the changed high target temperature. As a result, a difference in the combustion amount and the rotation speed of the fan between the one hot-water supplier and other hot-water suppliers is reduced, and also a difference in pressure of the combustion exhaust among the respective hot-water suppliers is reduced, which makes it possible to prevent occurrence of combustion failure and the like even when the common vent system is adopted.

In the connected hot-water supply system of the present invention, the burner of each of the hot-water suppliers is constituted of a plurality of burner blocks, the hot-water supply controller of each of the hot-water suppliers controls the combustion amount of the burner based on heating power of the respective burner blocks and a combination of the burner blocks to be combusted, and when the combustion regulator of the connection control unit detects dispersion in the rotation speed of the fan among the respective hot-water suppliers and when there are a plurality of combinations of the burner blocks having an identical combustion amount but a different rotation speed of the fan, the combustion regulator instructs the hot-water supply controller of each of the hot-water suppliers to select a combination of the burner blocks that provides a high rotation speed of the fan for combustion. Or in the connected hot-water supply system of the present invention, the burner of each of the hot-water suppliers is constituted of a plurality of burner blocks, the hot-water supply controller of each of the hot-water suppliers controls the combustion amount of the burner based on heating power of the respective burner blocks and a combination of the burner blocks to be combusted, and when the combustion regulator of the connection control unit detects dispersion in the rotation speed of the fan among the respective hot-water suppliers, the combustion regulator instructs the hot-water supply controller of each of the hot-water suppliers excluding any one hot-water supplier to control the combustion amount of the burner so that the fan has a specified rotation speed or more.

Accordingly, the fan speed is less likely to be minimized in each combination of the burner blocks of the respective hot-water suppliers. This makes it possible to prevent, as much as possible, the difference in pressure of the combustion exhaust among the respective hot-water suppliers from increasing, and to thereby prevent occurrence of combustion failure and the like even when the common vent system is adopted.

When the hot-water supply controller of each of the hot-water suppliers controls the combustion amount of the burner so that the rotation speed of the fan reaches a specified speed or more, the fan in one hot-water supplier is allowed to have a rotation speed less than the specified speed. This enables the connected hot-water supply system to perform hot-water supply operation even when the hot-water supply amount is extremely small.

DETAILED DESCRIPTION OF THE PREFERRED EMBODIMENT

Figure 1:
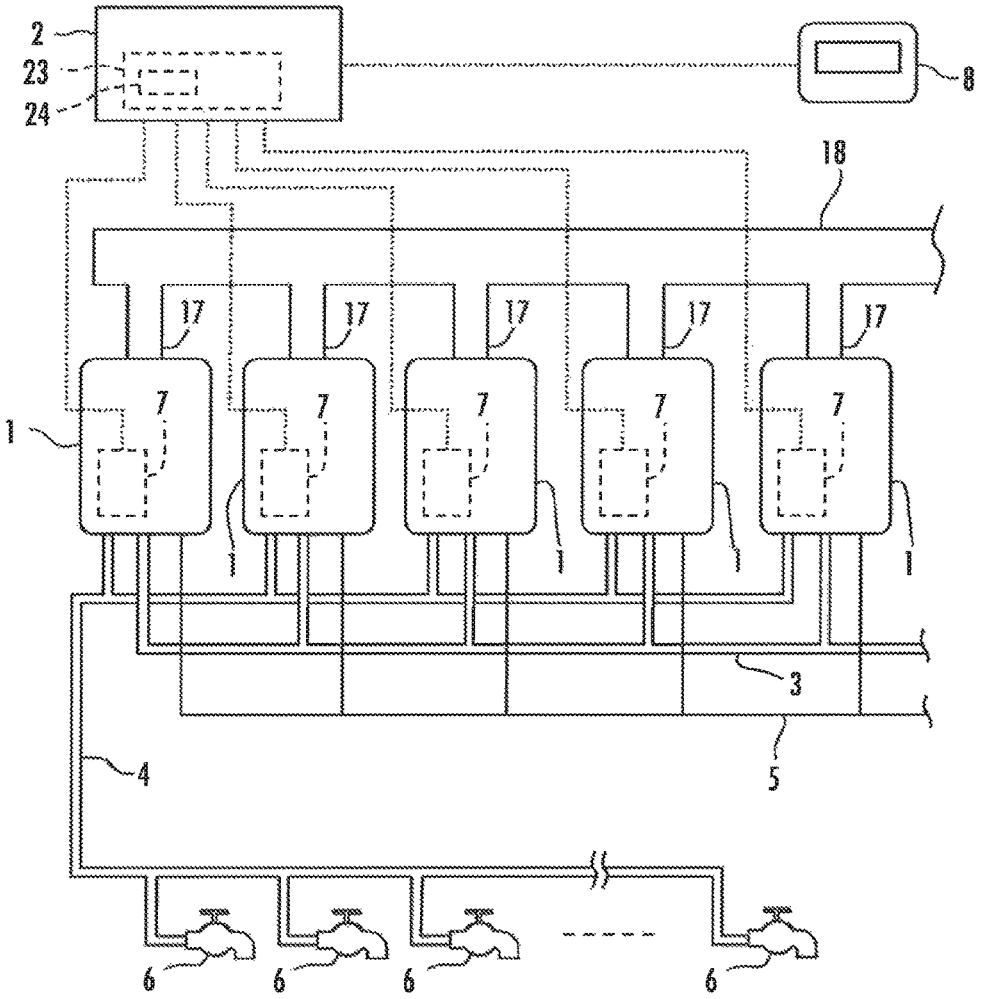
FIG. 1 is a schematic view illustrating an embodiment of a connected hot-water supply system of the present invention.

An embodiment of the present invention will be described hereinbelow with reference to the accompanying drawings. As illustrated in FIG. 1, a connected hot-water supply system in the embodiment of the present invention comprises a plurality of hot-water suppliers 1, a connection control unit 2 (connection control unit) configured to control each of the hot-water suppliers 1, a water pipe 3 configured to supply water to each of the hot-water suppliers 1, a hot-water pipe 4 configured to deliver hot water from each of the hot-water suppliers 1, and a gas supply pipe 5 configured to supply gas to each of the hot-water suppliers 1. The hot-water pipe 4 is connected to a plurality of faucets 6.

The hot-water supplier 1 is equipped with a hot-water supply controller 7 that is an electronic unit constituted by a microcomputer and the like. The connection control unit 2 is equipped with a remote controller 8 configured to operate the hot-water supply temperature of the connected hot-water supply system by remote control.

Figure 2:
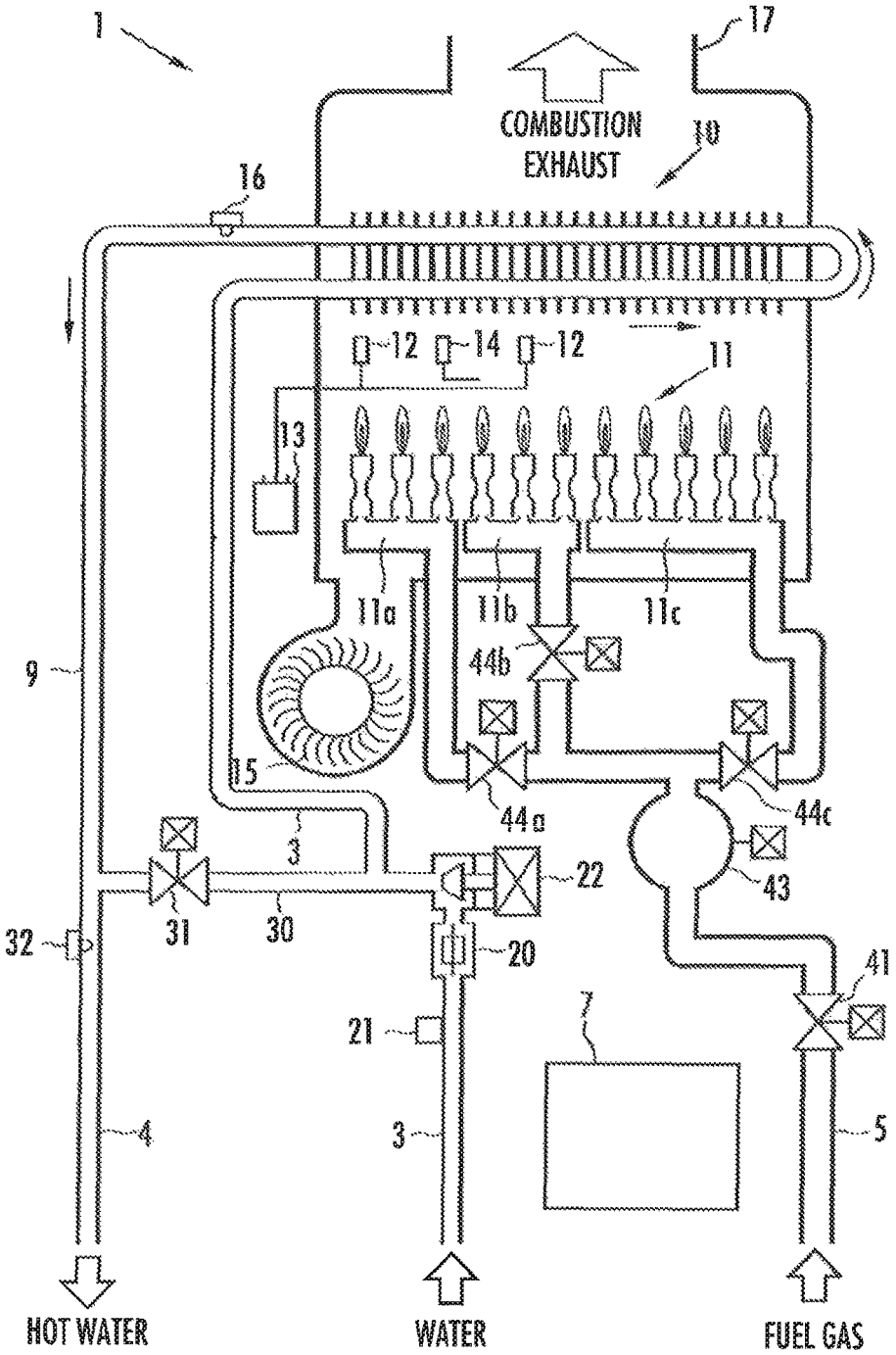
FIG. 2 is an explanatory view illustrating a hot-water supplier of the connected hot-water supply system of the present embodiment.

As illustrated in FIG. 2, the hot-water supplier 1 is equipped with a water flow pipe 9 (water flow passage) configured to connect the water pipe 3 and the hot-water pipe 4 in a manner as to permit water to flow. The water flow pipe 9 is provided with a heat exchanger 10.

The hot-water supplier 1 also comprises a gas burner 11 configured to combust fuel gas supplied from the gas supply pipe 5 to generate combustion exhaust, a spark plug 12 configured to ignite the gas burner 11, an ignitor 13 configured to apply high voltage to the spark plug 12, a flame rod 14 configured to detect the presence of a burning flame of the gas burner 11, a fan 15 configured to supply combustion air to the gas burner 11, and a heat exchanging temperature sensor 16 configured to detect the temperature of hot water fed from the heat exchanger 10.

The hot-water supplier 1 uses the combustion exhaust generated by the gas burner 11 to heat the water supplied to the water flow pipe 9 through the heat exchanger 10, and supplies the obtained hot water to the hot-water pipe 4. The gas burner 11 is constituted of first to third burner blocks 11*a*, 11*b*, and 11*c*.

The combustion exhaust generated by the gas burner 11 is discharged to the outside through an exhaust duct 17 (exhaust passage). As illustrated in FIG. 1, the exhaust duct 17 extending from each of the hot-water suppliers 1 is connected to a common exhaust duct 18 (common exhaust passage). The hot-water supplier 1 adopts a so-called common vent system. The common exhaust duct 18 collects the combustion exhaust sent from the exhaust ducts 17 of the respective hot-water suppliers 1 and discharges the collected combustion exhaust flow.

As illustrated in FIG. 2, the hot-water supplier 1 comprises a supplied water flow rate sensor 20 (water amount detector) configured to detect the flow rate of water supplied from the water pipe 3, a supplied water temperature sensor 21 configured to detect the temperature of the water supplied from the water pipe 3, and a water supply servo valve 22 (flow regulating valve) configured to regulate the flow rate of the water supplied from the water pipe 3.

The water flow pipe 9 is equipped with a bypass pipe 30 configured to guide the water supplied from the water pipe 3 to the hot-water pipe 4 without passing the heat exchanger 10. The bypass pipe 30 is provided with a bypass servo valve 31 configured to adjust the opening degree of the bypass pipe 30. The water flow pipe 9 is equipped with a hot-water supply temperature sensor 32 (hot-water supply temperature detector) provided downstream from a confluence portion with the bypass pipe 30 to detect the temperature of the hot water supplied to the hot-water pipe 4.

The gas supply pipe 5 is equipped with a main solenoid valve 41 and a gas proportional control valve 43. The downstream part of the gas supply pipe 5 is branched into three branches which lead to first to third burner blocks 11*a*, 11*b*, and 11*c*.

The branch connected to the first burner block 11*a* is equipped with a first switchover solenoid valve 44*a* that switches supply and cutoff of the fuel gas to the first burner block 11*a*. The branch connected to the second burner block 11*b* is equipped with a second switchover solenoid valve 44*b* that switches supply and cutoff of the fuel gas to the second burner block 11*b*. The branch connected to the third burner block 11*c* is equipped with a third switchover solenoid valve 44*c* that switches supply and cutoff of the fuel gas to the third burner block 11*c*.

The hot-water supply controller 7 receives signals instructing operation/shutdown of the hot-water supplier 1, setting of operating conditions, and the like from the connection control unit 2. The hot-water supply controller 7 also receives detection signals from the flame rod 14, the heat exchanging temperature sensor 16, the supplied water flow rate sensor 20, the supplied water temperature sensor 21, and the hot-water supply temperature sensor 32.

In response to the control signals output from the hot-water supply controller 7, the operation of the ignitor 13, the fan 15, the water supply servo valve 22, the bypass servo valve 31, the main solenoid valve 41, the gas proportional control valve 43, the first switchover solenoid valve 44*a*, the second switchover solenoid valve 44*b*, and the third switchover solenoid valve 44*c* are controlled. The hot-water supply controller 7 detects the combustion amount of the gas burner 11 based on the opening and closing operation condition of the first switchover solenoid valve 44*a*, the second switchover solenoid valve 44*b*, and the third switchover solenoid valve 44*c* and based on the opening degree of the gas proportional control valve 43.

The hot-water supply controller 7 executes a program preinstalled in a memory by the microcomputer. The hot-water supply controller 7 opens the water supply servo valve 22 when the hot-water supplier 1 is in an operating state, and supplies combustion air to the gas burner 11 with the fan 15 when the flow rate of the water detected by the supplied water flow rate sensor 20 reaches a preset ignition water amount or more. While spark discharge is generated by applying high voltage to the spark plug 12 by the ignitor 13, the main solenoid valve 41 and the first to third switchover solenoid valves 44*a* to 44*c* are opened to ignite the gas burner 11.

The hot-water supply controller 7 regulates opening and closing of the first to third switchover solenoid valves 44*a* to 44*c*, the opening degree of the gas proportional control valve 43, and the rotation speed of the fan 15 to control the combustion amount of the gas burner 11 so that the temperature of the hot water supplied to the hot-water pipe 4 detected by the hot-water supply temperature sensor 32 reaches a hot-water supply temperature set with the remote controller 8.

Figure 3:
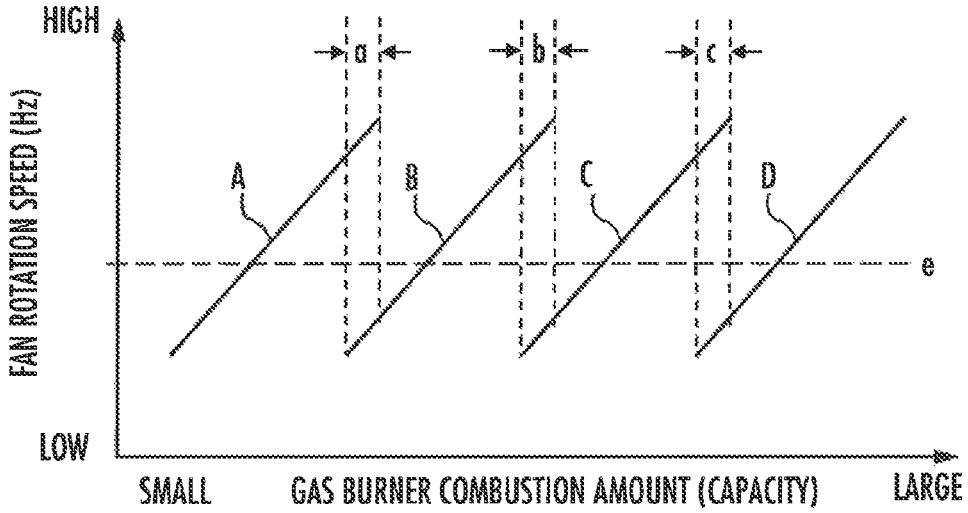
FIG. 3 is a graph view illustrating the relation between a combustion amount and a rotation speed of the fan.

The gas burner 11 forms, for example, four combustion capacity ranges from a maximum combustion amount to a minimum combustion amount depending on the combination of the burner blocks 11*a*, 11*b*, and 11*c* to be combusted. In the four combustion capacity ranges, the rotation speeds of the fan 15 corresponding to the respective combustion amounts are preset. That is, the four combustion capacity ranges are expressed by four lines A, B, C, and D that represent the relation between the combustion amount and the rotation speed of the fan 15 as illustrated in FIG. 3. The hot-water supply controller 7 controls the fan 15 along any one of the lines in accordance with the combination of the burner blocks 11*a*, 11*b*, and 11*c* to be combusted. The inclination of the lines A, B, C, and D is defined by the relation between the fire power and the rotation speed (Hz) of the fan 15. End portions of the lines A, B, C and D which are adjacent to each other vertically overlap with each other so as to have the same combustion amount. These overlapping portions a, b, and c include a high rotation speed and a low rotation speed of the fan 15 depending on difference in combination of the burner blocks 11*a*, 11*b*, and 11*c*.

When the faucet 6 attached to the top end of the hot-water pipe 4 is closed, and the flow rate of the water supplied from the water pipe 3, which is detected by the supplied water flow rate sensor 20, becomes lower than the ignition water amount, the hot-water supply controller 7 closes the main solenoid valve 41, the gas proportional control valve 43, the first switchover solenoid valve 44*a*, the second switchover solenoid valve 44*b*, and the third switchover solenoid valve 44*c* to stop combustion of the gas burner 11.

The connection control unit 2, which is communicably connected with the hot-water supply controller 7 of each of the hot-water suppliers 1, sends instructions relating to control of the hot-water supplier 1 to the hot-water supply controller 7. The connection control unit 2 comprises, as a function, a combustion regulator 23 configured to regulate an individual combustion amount for each of the hot-water supply controllers 7 of the respective hot-water suppliers 1 as illustrated in FIG. 1. The combustion regulator 23 further comprises, as a function, a target temperature setting portion 24 configured to set an individual target hot-water supply temperature for each of the hot-water supply controllers 7 of the respective hot-water suppliers 1.

The hot-water supply controller 7 of each of the hot-water suppliers 1 transmits to the connection control unit 2 the information about hot-water supply operation, such as water amount data (detected water amount) detected by the supplied water flow rate sensor 20, and hot-water supply temperature data (detected temperature) detected by the hot-water supply temperature sensor 32.

In the system configuration illustrated in FIG. 1, five hot-water suppliers 1 are connected to the connection control unit 2. When hot-water supply operation is not performed, the water supply servo valve 22 of one hot-water supplier 1 is opened, while the water supply servo valves 22 of the remaining four hot-water suppliers 1 are closed.

When a desired hot-water supply temperature is set with the remote controller 8 and hot-water supply from the faucet 6 is started, one hot-water supplier 1 with an opened water supply servo valve 22 starts to operate, and the water amount data (amount of hot-water supply) detected by the supplied water flow rate sensor 20 is transmitted to the connection control unit 2.

The target temperature setting portion 24 of the connection control unit 2 sets, for the hot-water supply controller 7 of the hot-water supplier 1 which has started hot-water supply operation, a hot-water supply temperature set with the remote controller 8 as a target hot-water supply temperature. Accordingly, the hot-water supply controller 7 of the hot-water supplier 1 which performs hot-water supply operation controls the combustion amount of the gas burner 11 so that hot-water is supplied at the target hot-water supply temperature in accordance with the water amount detected by the supplied water flow rate sensor 20, and rotates the fan 15 at the speed corresponding to the combustion amount of that time.

If the hot-water supply amount is close to an upper limit of the capacity of one hot-water supplier 1 at that time, the connection control unit 2 instructs one of the stopped hot-water suppliers 1 to start hot-water supply operation (instructs the hot-water supply controller 7 of a hot-water supplier 1 to be added to open the water supply servo valve 22). In this way, the number of the hot-water suppliers 1 that perform hot-water supply operation is increased in response to the instruction of the connection control unit 2 corresponding to the amount of hot-water supply. When the water supply servo valves 22 of five hot-water suppliers 1 are opened, all the five hot-water suppliers 1 are in hot-water supply operation state.

Contrary to this, when the amount of hot-water supply decrease while a plurality of hot-water suppliers 1 are in operation, the number of the hot-water suppliers 1 that perform hot-water supply operation is reduced in response to the instruction of the connection control unit 2.

While, for example, all the five hot-water suppliers 1 are in hot-water supply operation, the water amount detected by the supplied water flow rate sensor 20 may become extremely small only in any one of the hot-water suppliers 1 (due to such causes as the water supply servo valve 22 clogged with dirt, operation failure, or pipe resistance at the time of installation). In this case, the hot-water supply controller 7 of the pertinent hot-water supplier 1 determines that the amount of hot-water to be used has decreased and causes an extreme drop of the combustion amount of the gas burner 11. This drop in the combustion amount causes an extreme drop in the rotation speed of the fan 15 in the pertinent hot-water supplier 1, so that the pressure of the combustion exhaust passing through the exhaust duct 17 of that hot-water supplier 1 becomes extremely low.

When the pressure of the combustion exhaust of one hot-water supplier 1, out of five hot-water suppliers 1, is extremely low, a large difference in combustion exhaust pressure between the one hot-water supplier 1 and other four hot-water suppliers provides a large resistance to the combustion exhaust flowing from the exhaust duct 17 to the common exhaust duct 18, which makes it difficult to deliver the combustion exhaust to the common exhaust duct 18. Accordingly, the hot-water supplier 1 having an extremely low combustion exhaust pressure may fail to supply combustion air to the gas burner 11, which may result in combustion failure.

Accordingly, in the connection control unit 2, the combustion regulator 23 regulates the combustion amount in each of the hot-water suppliers 1 through the hot-water supply controller 7 of each of the hot-water suppliers 1 so as to reduce a difference in the pressure of the combustion exhaust flowing from the exhaust ducts 17 of the respective hot-water suppliers 1 to the common exhaust duct 18.

Figure 4:
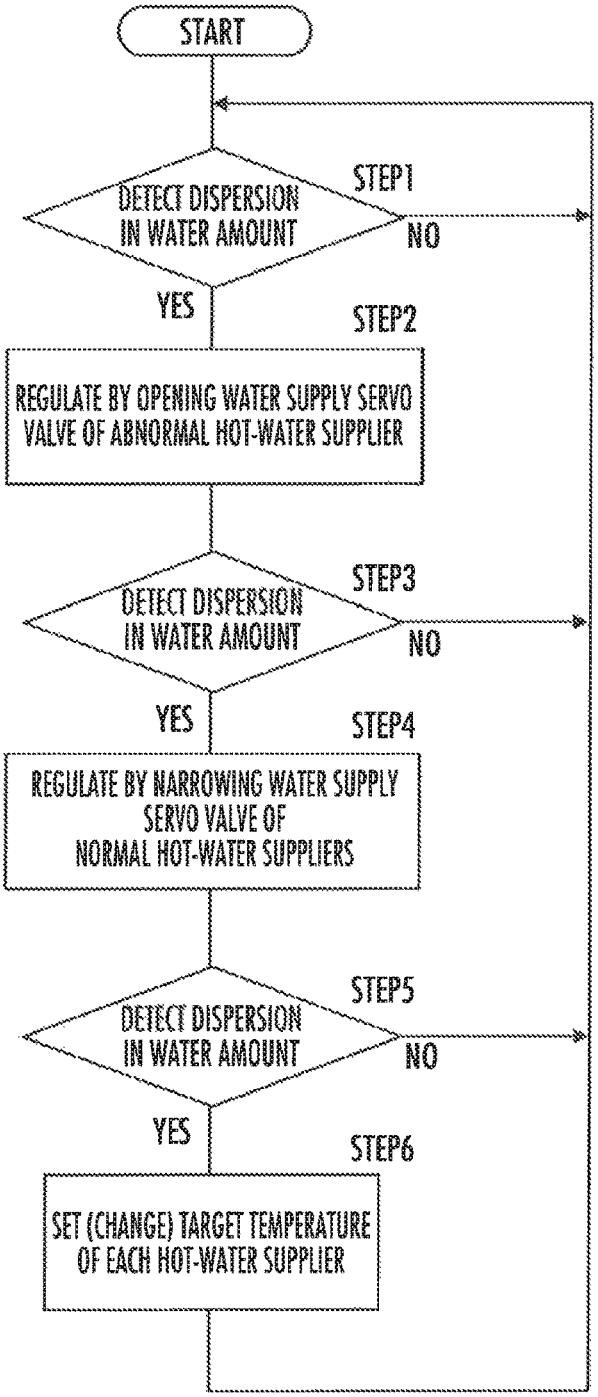
FIG. 4 is a flow chart illustrating processing of a connection control unit in the connected hot-water supply system of the present embodiment.

The operation of the combustion regulator 23 in this case will be described with reference to FIG. 4. First, as illustrated in FIG. 4, the amount of water extracted from each of the hot-water suppliers 1 and detected by the supplied water flow rate sensor 20 is compared in STEP 1. If dispersion in the detected water amount (i.e., dispersion in the combustion amount) among the respective hot-water suppliers 1 is detected, the processing proceeds to STEP 2. At this point, the hot-water supplier 1 having an extremely low water amount is identified (the hot-water supplier 1 having an extremely low water amount is hereinbelow referred to as an abnormal hot-water supplier 1, and other hot-water suppliers 1 are referred to as normal hot-water suppliers 1). Accordingly, in STEP 2, the combustion regulator 23 instructs the hot-water supply controller 7 of the abnormal hot-water supplier 1 to further open the water supply servo valve 22.

In STEP 3, it is determined whether or not the dispersion in the detected water amount (i.e., dispersion in the combustion amount) among the respective hot-water suppliers 1 is eliminated. If the dispersion is not eliminated, the processing proceeds to STEP 4.

In STEP 4, the hot-water supply controllers 7 of the normal hot-water suppliers 1 are instructed to narrow the opening degree of the water supply servo valves 22 of the normal hot-water suppliers 1 until the opening degree becomes equal or close to the opening degree of the water supply servo valve 22 of the abnormal hot-water supplier 1.

In STEP 5, it is determined whether or not the dispersion in the detected water amount (i.e., dispersion in the combustion amount) among the respective hot-water suppliers 1 is eliminated. If the dispersion in the detected water amount is not eliminated after going through STEP 4, the processing proceeds to STEP 6.

In STEP 6, the target temperature setting portion 24 of the combustion regulator 23 sets (changes) an individual target temperature for each of the hot-water suppliers 1. A specific description is given of the above operation performed on the five connected hot-water suppliers 1. For example, the hot-water supply temperature set for the connected hot-water supply system by using the remote controller 8 is 42° C. When sufficient combustion amount is not obtained in one hot-water supplier 1 that is an abnormal hot-water supplier 1 even after going through STEP 2 and STEP 3, the target temperature setting portion 24 sets a target temperature of 46° C. for the hot-water supply controller 7 of the abnormal hot-water supplier 1. As a result, the target temperature of the abnormal hot-water supplier 1, which has performed hot-water supply operation with the target temperature of 42° C., is changed to 46° C.

By changing the target temperature, the hot-water supply controller 7 of the abnormal hot-water supplier 1 increases the hot-water supply temperature even though the flow rate in the water flow pipe 9 of the abnormal hot-water supplier 1 is not sufficient. As a result, the combustion amount of the gas burner 11 increases. In connection with this increase, the rotation speed of the fan 15 in the abnormal hot-water supplier 1 also sufficiently increases.

The target temperature setting portion 24 sets a target temperature of 41° C. for the remaining four normal hot-water suppliers 1. Accordingly, the target temperature of the four normal hot-water suppliers 1, which have performed hot-water supply operation with a target temperature of 42° C., is changed to 41° C. In this case, since the target temperature of the four normal hot-water suppliers 1 is changed, the rotation speed of the fans 15 in the four normal hot-water suppliers 1 is dropped to approximately the same level as the rotation speed of the fan 15 of the abnormal hot-water supplier 1.

Accordingly, even in the case where the dispersion in the detected water amount is not eliminated, it becomes possible to reduce a difference in pressure of the combustion exhaust between the abnormal hot-water supplier 1 and the normal hot-water suppliers 1 while the hot-water supply temperature set for the connected hot-water supply system by using the remote controller 8 is maintained. As a result, combustion failure in the abnormal hot-water supplier 1 can be prevented.

When only STEP 5 to STEP 6 are performed, the difference in the pressure of the combustion exhaust between the abnormal hot-water supplier 1 and the normal hot-water suppliers 1 can still be reduced, so that the combustion failure in the abnormal hot-water supplier 1 can be prevented.

The above-configured connected hot-water supply system can prevent combustion failure by increasing the rotation speed of the fan 15 of the hot-water supplier having an extreme drop of the combustion amount. Furthermore, in the case where the gas burner 11 is constituted of a plurality of burner blocks 11*a*, 11*b*, and 11*c* as in the hot-water suppliers 1 which constitute the connected hot-water supply system of the present embodiment, it is possible to reduce a difference in the pressure of combustion exhaust among the respective hot-water suppliers 1 by controlling the combustion amount in each combination of the burner blocks 11*a*, 11*b*, and 11*c* to be combusted based on the four lines A, B, C and D illustrated in FIG. 3.

That is, the combustion regulator 23 of the connection control unit 2 can instruct the hot-water supply controller 7 of each of the hot-water suppliers 1 to select a combination of the burner blocks 11*a*, 11*b*, and 11*c* that ensures a high rotation speed of the fan 15 in the overlapping portions a, b, and c of the lines A, B, C and D as illustrated in FIG. 3. According to this configuration, it becomes possible to prevent the rotation speed of the fan 15 from becoming extremely low in the overlapping portions a, b, and c of the lines A, B, C and D.

As illustrated in FIG. 3, the combustion regulator 23 of the connection control unit 2 can set a rotation speed line e used as a lower limit for the rotation speed of the fan 15 and instruct the hot-water supply controller 7 of each of the hot-water suppliers 1 to rotate the fan 15 at the speed equal to or more than the rotation speed line e in any combination of the burner blocks 11*a*, 11*b*, and 11*c*. According to this configuration, the difference in the rotation speed of the fan 15 among the respective hot-water suppliers 1 can be made as small as possible.

Although the hot-water supplier 1 comprising a gas burner 11 which is constituted of three burner blocks 11*a*, 11*b*, and 11*c* has been described in the present embodiment, the number of the burner blocks is not limited to three.

What is claimed is:

1. A connected hot-water supply system, comprising a plurality of hot-water suppliers connected to each other, the hot-water suppliers each comprising a water flow passage, a heat exchanger provided in the water flow passage, a burner configured to heat the heat exchanger, a fan configured to make combustion air and combustion exhaust of the burner forcibly flow, an exhaust passage configured to discharge combustion exhaust of the burner that passed the heat exchanger by airstream by the fan, and a hot-water supply controller configured to control hot-water supply operation, wherein the hot-water supply controller in each of the hot-water suppliers is connected to a connection control unit configured to control linked operation of the respective hot-water suppliers, the exhaust passage of each of the hot-water suppliers is connected to a common exhaust passage configured to collectively discharge combustion exhaust from each of the hot-water suppliers, the fan of each of the hot-water suppliers is controlled to have a rotation speed corresponding to a combustion amount of the burner by the hot-water supply controller to deliver the combustion exhaust in the exhaust passage to the common exhaust passage, the connection control unit comprises a combustion regulator configured to regulate the combustion amount in each of the hot-water suppliers through the hot-water supply controller in each of the hot-water suppliers and to thereby regulate the rotation speed of the fan in each of the hot-water suppliers, the combustion regulator acquires information about hot-water supply operation from the hot-water supply controller of each of the hot-water suppliers, and when dispersion of the rotation speed of the fan among the respective hot-water suppliers is detected, the combustion regulator regulates the combustion amount of the respective hot-water suppliers to reduce a difference in the rotation speed of the fan among the respective hot-water suppliers, the hot-water suppliers each comprise a water amount detector configured to detect an amount of water flow in the water flow passage and a flow regulating valve configured to regulate the amount of water flow in the water flow passage, the hot-water supply controller of each of the hot-water suppliers regulates the combustion amount of the burner in accordance with the water amount detected by the water amount detector, and the combustion regulator of the connection control unit acquires the water amount detected by the water amount detector, as information about the hot-water supply operation, from the hot-water supply controller of each of the hot-water suppliers, and when dispersion in the detected water amount among the respective hot-water suppliers is detected, the combustion regulator determines that dispersion in the rotation speed of the fan among the respective hot-water suppliers occurred, and controls the flow regulating valve of each of the hot-water suppliers through the hot-water supply controller of each of the hot-water suppliers while maintaining a number of the hot-water suppliers in hot-water supply operation to reduce a difference in the detected water amount among the respective hot-water suppliers.

2. The connected hot-water supply system according to claim 1, wherein the hot-water suppliers each comprise a hot-water supply temperature detector configured to detect temperature of hot water obtained from the water flow passage, the hot-water supply controller of each of the hot-water suppliers regulates the combustion amount of the burner so that the temperature detected by the hot-water supply temperature detector reaches a target temperature, the combustion regulator of the connection control unit comprises a target temperature setting portion configured to set a target temperature for each of the hot-water supply controllers in each of the hot-water suppliers, and when the combustion regulator of the connection control unit detects dispersion in the combustion amount among the respective hot-water suppliers, the target temperature setting portion determines that dispersion in the rotation speed of the fan among the respective hot-water suppliers occurred, and sets the target temperature for each of the hot-water supply controllers in each of the hot-water suppliers to reduce a difference in the combustion amount among the respective hot-water suppliers.

3. The connected hot-water supply system according to claim 1, wherein the burner of each of the hot-water suppliers is constituted of a plurality of burner blocks, the hot-water supply controller of each of the hot-water suppliers controls the combustion amount of the burner based on heating power of the respective burner blocks and a combination of the burner blocks to be combusted, when the combustion regulator of the connection control unit detects dispersion in the rotation speed of the fan among the respective hot-water suppliers and when there are a plurality of combinations of the burner blocks having an identical combustion amount but a different rotation speed of the fan, the combustion regulator instructs the hot-water supply controller of each of the hot-water suppliers to select a combination of the burner blocks that provides a higher rotation speed of the fan for combustion.

4. The connected hot-water supply system according to claim 1, wherein the burner of each of the hot-water suppliers is constituted of a plurality of burner blocks, the hot-water supply controller of each of the hot-water suppliers controls the combustion amount of the burner based on heating power of the respective burner blocks and a combination of the burner blocks to be combusted, and when the combustion regulator of the connection control unit detects dispersion in the rotation speed of the fan among the respective hot-water suppliers, the combustion regulator instructs the hot-water supply controller of each of the hot-water suppliers excluding any one hot-water supplier to control the combustion amount of the burner so that the fan has a specified rotation speed or more.

* * * * *